US007566227B2

(12) United States Patent
Li

(10) Patent No.: US 7,566,227 B2
(45) Date of Patent: Jul. 28, 2009

(54) COMPUTER SYSTEM WITH RISER CARD

(75) Inventor: Zhan-Yang Li, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/042,349

(22) Filed: Mar. 5, 2008

(65) Prior Publication Data

US 2009/0111295 A1 Apr. 30, 2009

(30) Foreign Application Priority Data

Oct. 30, 2007 (CN) ..... 2007 2 0201243 U

(51) Int. Cl.
*H01R 9/00* (2006.01)

(52) U.S. Cl. ..... 439/65; 439/631; 361/752

(58) Field of Classification Search ..... 439/65, 439/631, 638, 225, 632, 636; 361/752, 788
See application file for complete search history.

(56) References Cited

U.S. PATENT DOCUMENTS

| | | | | |
|---|---|---|---|---|
| 6,147,871 | A | 11/2000 | DeWitt et al. | |
| 6,422,876 | B1 * | 7/2002 | Fitzgerald et al. | 439/61 |
| 6,508,674 | B1 * | 1/2003 | Svenkeson et al. | 439/631 |
| 7,045,891 | B2 * | 5/2006 | Choi | 257/723 |
| 7,075,797 | B1 | 7/2006 | Leonard et al. | |
| 2003/0003778 | A1 * | 1/2003 | Huang | 439/65 |
| 2008/0199132 | A1 * | 8/2008 | Pitwon | 385/53 |
| 2008/0227305 | A1 * | 9/2008 | Sabo | 439/65 |

* cited by examiner

*Primary Examiner*—Hien Vu
(74) *Attorney, Agent, or Firm*—Frank R. Niranjan

(57) ABSTRACT

A riser card (10) includes a card body (11) and a connector (20). The card body defines an opening (12) therein, and has a first side and an opposite second side. The connector is secured in the opening of the card body, and has a first edge connector socket (22) facing away from the second side of the card body, and a second edge connector socket (24) facing away from the first side thereof. The first edge connector socket is located at the first side of the card body for insertion of an edge portion of one peripheral card therein, and the second edge connector socket is located at the second side of the card body for insertion of an edge portion of another peripheral card therein.

6 Claims, 6 Drawing Sheets

COMPUTER SYSTEM WITH RISER CARD

BACKGROUND

1. Technical Field

The present invention relates to computer systems, and more particularly to a computer system with a riser card installed therein.

2. General Background

Increased packaging densities in today's computer assemblies along with increased market demand for lower profile personal computer systems have fostered the use of riser cards for attaching peripheral cards to the computer systems. However, conventional riser cards can only receive peripheral cards at one side thereof. So, in use, after the riser cards and the peripheral cards are assembled in a computer chassis of the computer system, space in the computer chassis at the other side of the riser cards is left unused.

What is needed, therefore, is a riser card capable of receiving peripheral cards at more than one side thereof for efficiently using space in a computer chassis.

SUMMARY

A riser card includes a card body and a connector. The card body defines an opening therein, and has a first side and an opposite second side. The connector is secured in the opening of the card body, and has a first edge connector socket facing away from the second side of the card body, and a second edge connector socket facing away from the first side thereof. The first edge connector socket is located at the first side of the card body for insertion of an edge portion of one peripheral card therein, and the second edge connector socket is located at the second side of the card body for insertion of an edge portion of another peripheral card therein.

Other advantages and novel features will be drawn from the following detailed description of embodiments with attached drawings, in which:

DETAILED DESCRIPTION

Figure 1:
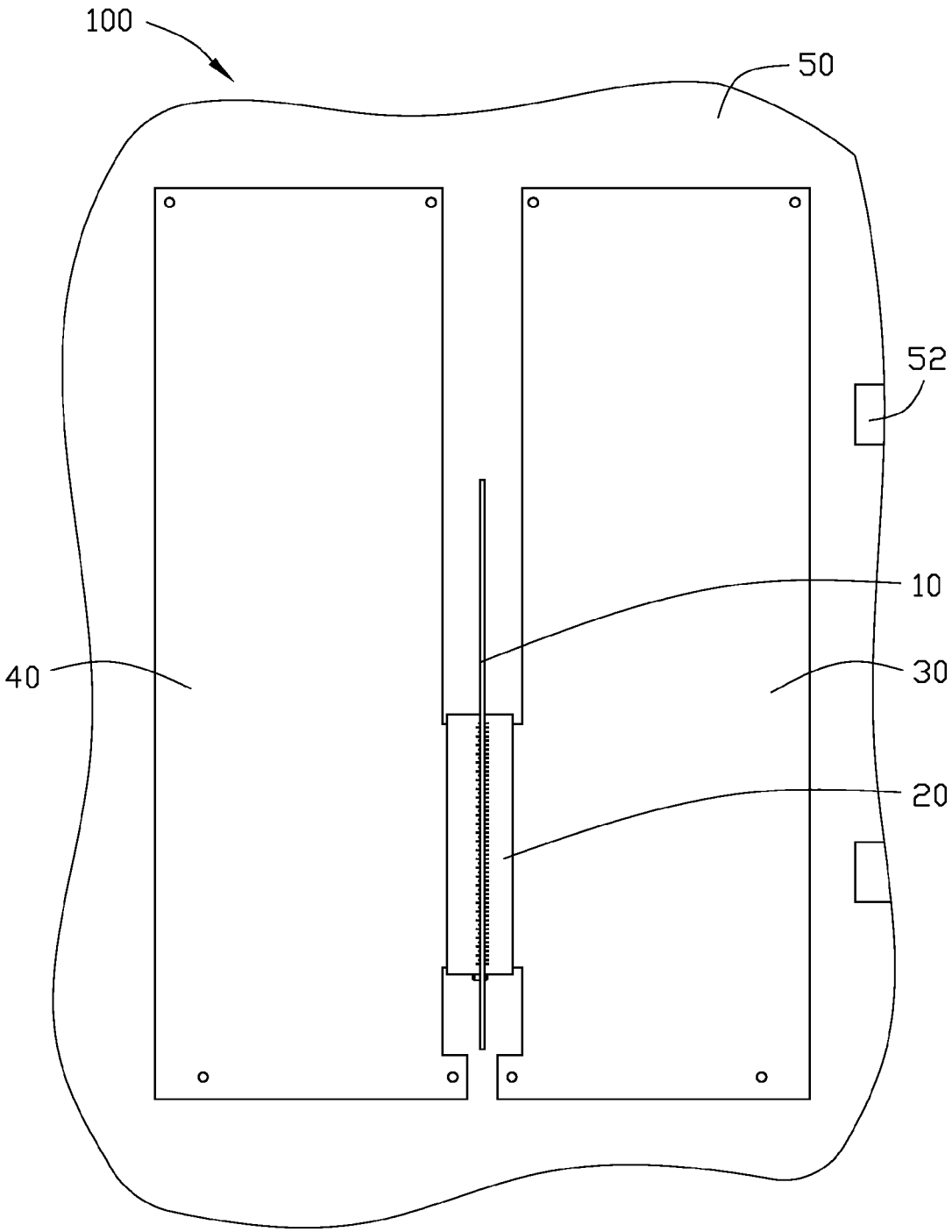
FIG. 1 is a partial top plan, assembled view of a computer system of a preferred embodiment of the present invention, the computer system including a motherboard, a riser card, and first and second peripheral cards.

Referring now to the drawings wherein depicted elements are not necessarily shown to scale and wherein like or similar elements are designated by the same reference numeral through the several views.

FIG. 1 illustrates an embodiment of the present invention of a small form factor personal computer system 100. The computer system 100 includes a motherboard 50 (partially shown in FIG. 1) secured in a computer chassis (not shown), a riser card 10 electrically coupled to a riser card connector (not shown) disposed on the motherboard 50, and first and second peripheral cards 30, 40 capable of being coupled to the riser card 10. The motherboard 50 has electrical components 52, electrically connected to each other according to a specific personal computer design architecture, such as well known uni- or multi-processing system architectures. Additional and complementary functions and features are provided by attaching peripheral cards, such as the first and second peripheral cards 30, 40, to the computer system. Such peripheral cards may, for example, comprise hard disk controllers for enhancing storage capacity of the computer system or communication devices for connecting the computer system to a local or a wide area network.

As is well known, the peripheral cards communicate with the computer system over one or more input/output (I/O) buses, where such buses comply with specified I/O protocols. Each bus also complies with a physical form factor, which defines among other things, a corresponding size, shape, and contact spacing. Such I/O protocols and form factors may be specified by standard specifications such as those relating to Peripheral Component Interconnect (PCI), AGP, ISA, PCL SCSL or Micro Channel. The specification for each bus form factor allows peripheral card manufacturers to produce cards that can attach to corresponding peripheral card connectors of the computer system.

Figure 2:
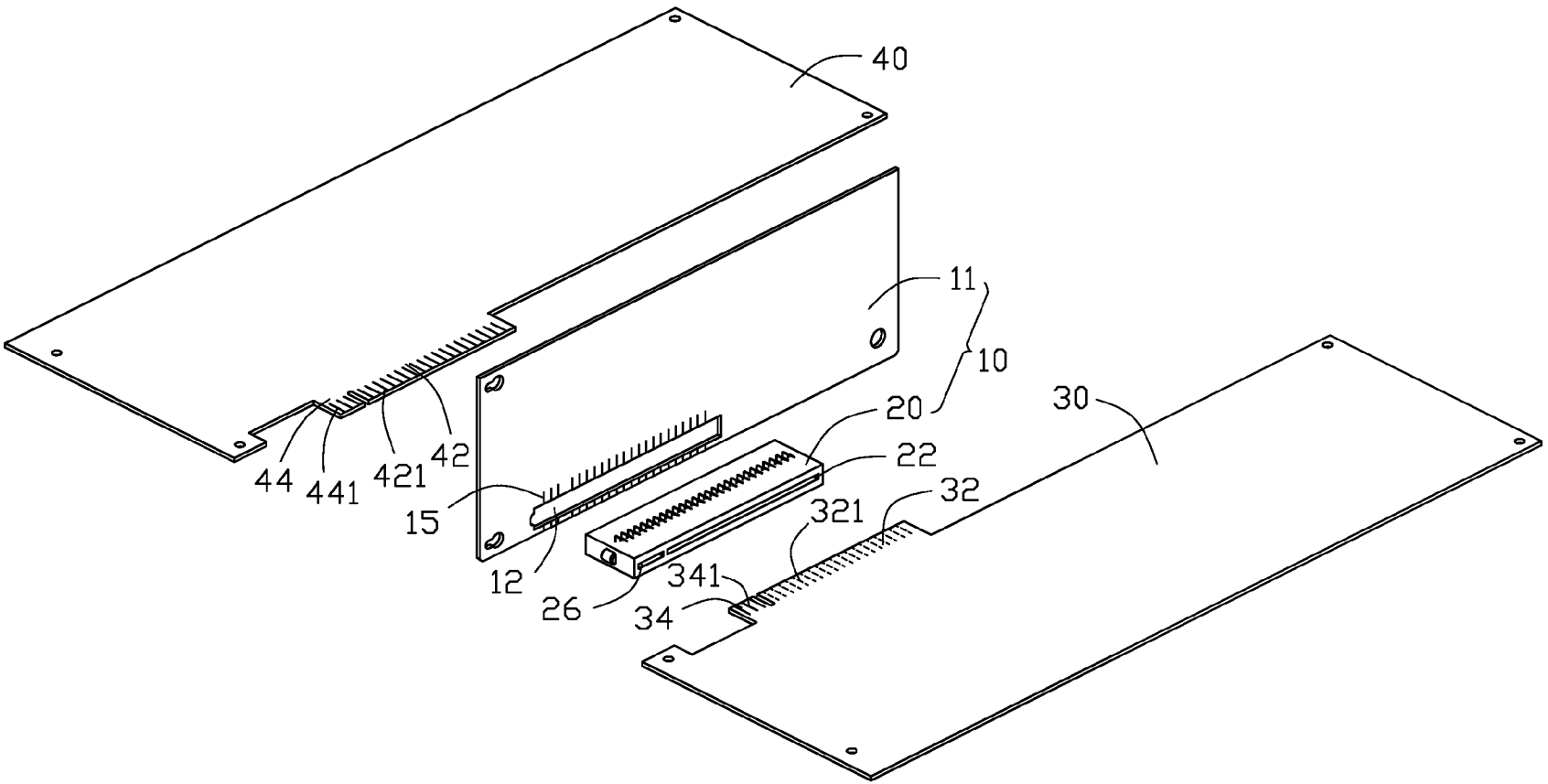
FIG. 2 is an isometric, exploded view of the riser card and the first and second peripheral cards of FIG. 1.
Figure 3:
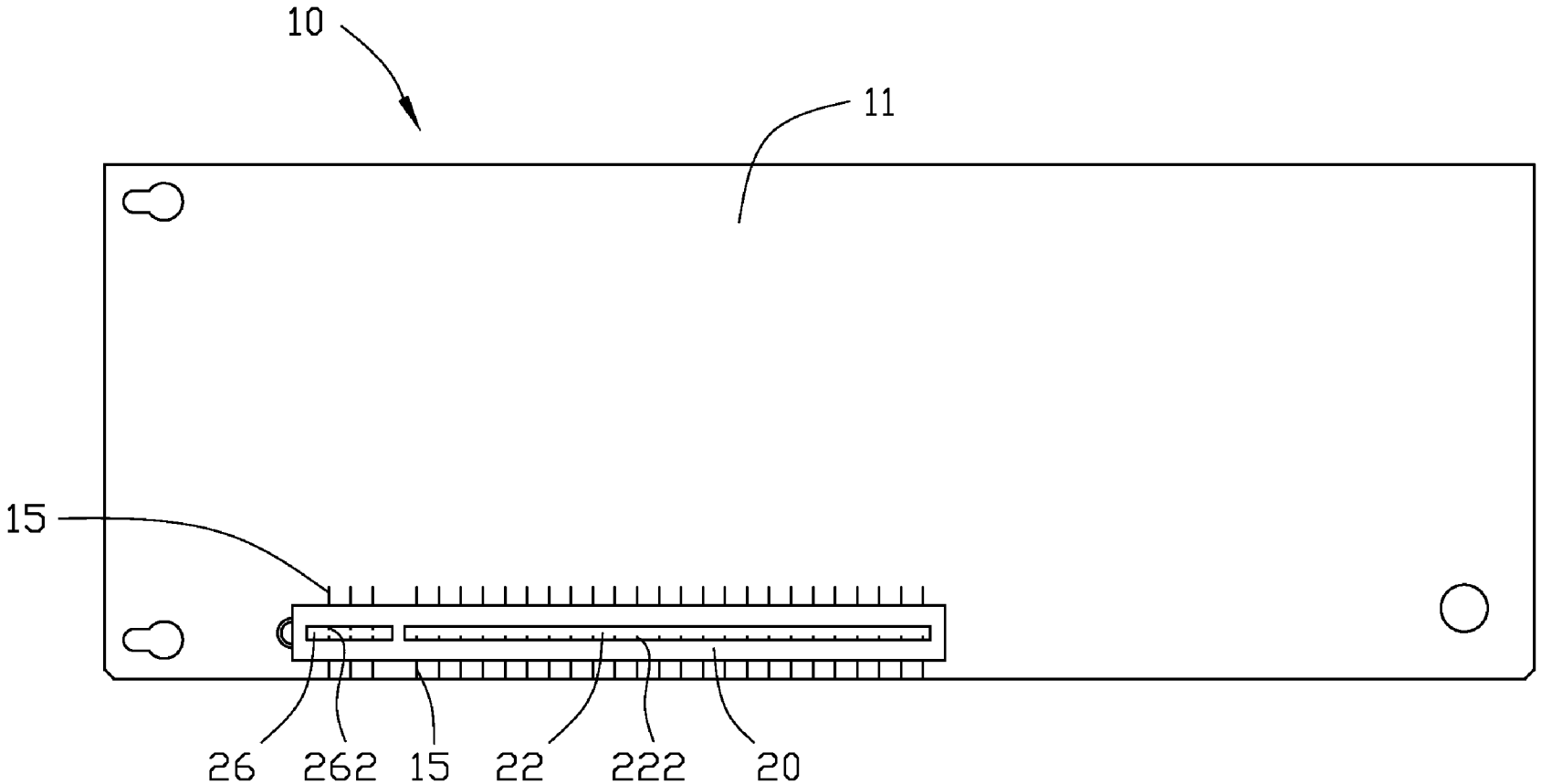
FIG. 3 is a front elevational view of the riser card of FIG. 2.
Figure 4:
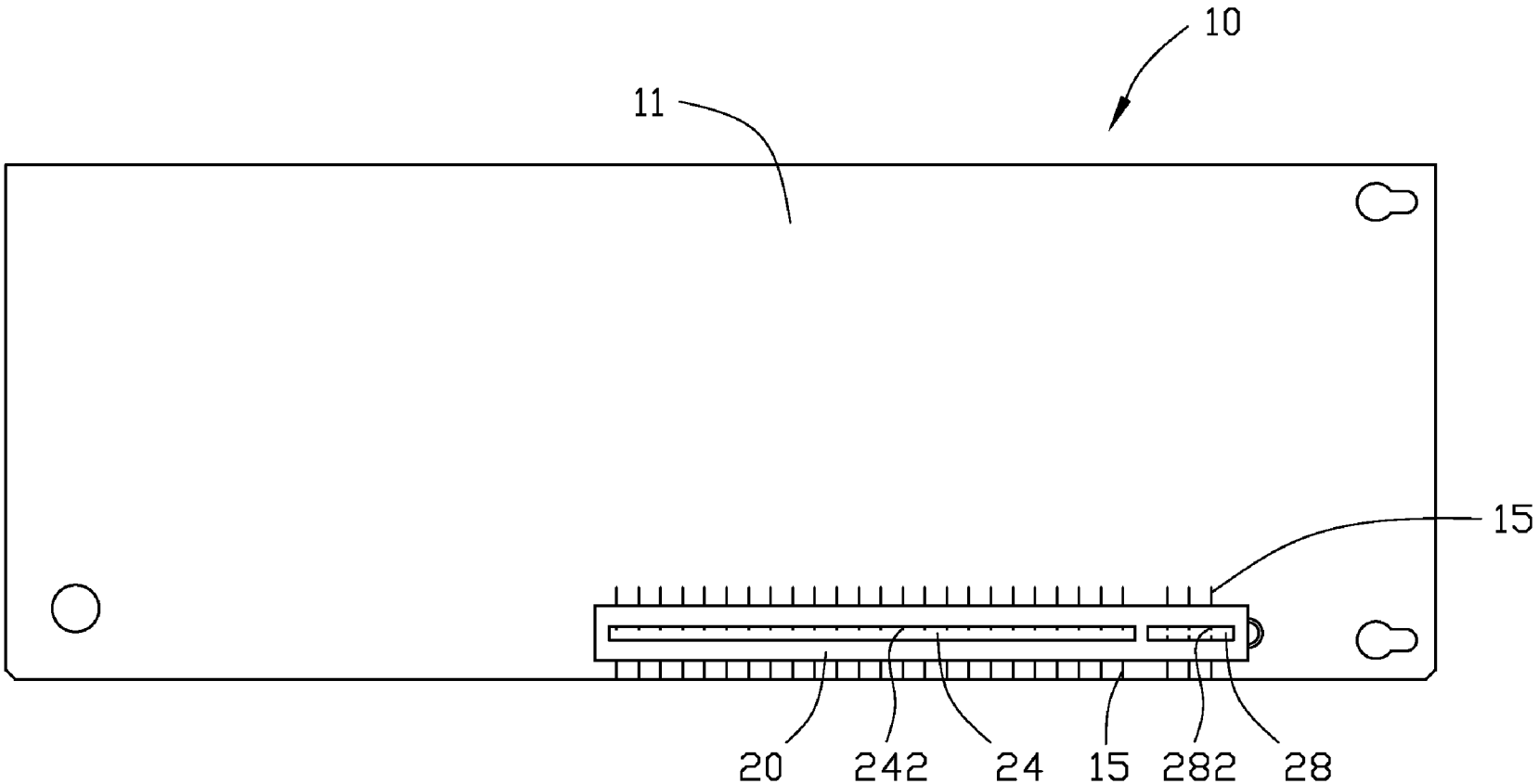
FIG. 4 is a rear elevational view of the riser card of FIG. 2.

Referring to FIGS. 1-2, a riser card 10 of an embodiment of the present invention may be fabricated from an epoxy glass composite or any other suitable material with electrically conductive metallic circuit traces 15 (partially shown in FIG. 2), and includes a card body 11 capable of being in electrical and functional connection with the motherboard 50. The card body 11 has a first side and a second side opposite to the first side, and defines an opening 12 therein. A connector 20, typically a standard option card connector, is configured for being secured in the opening 12. A first data edge connector socket 22 back-to-back with a second data edge connector sockets 24 and a first power edge connector socket 26 back-to-back with a second power edge connector socket 28 (shown in FIGS. 3-4) are defined in the connector 20. Referring also to FIGS. 3-4, each first and second edge connector sockets 22, 24 and each power first and second power edge connector sockets 26, 28 has face-to-face inner surfaces. A plurality of electrical contacts 222 is formed on one of the inner surface of the first data edge connector socket 22, and a plurality of electrical contacts 242 is formed on one of the inner surface of the second data edge connector socket, which faces the one of the inner surface of the first data edge connector socket 22. A plurality of electrical contacts 262, 282 is respectively formed on the inner surfaces the power edge connector sockets 26, 28. The electrical contacts 222, 242, 262, and 282 are electrically coupled to the circuit traces 15 of the riser card 10.

First and second peripheral cards 30, 40 are provided in the preferred embodiment. Each of the first and second peripheral cards 30, 40 has a data inserting edge portion 32, 42 capable of being respectively received in the data edge connector sockets 22, 24 of the connector 20, and a power inserting edge portion 34, 44 capable of being respectively received in the power edge connector socket 26, 28. A plurality of electrical contacts 321 is formed on a single surface of the data inserting edge portion 32, and a plurality of electrical contacts 341 is formed on opposite surface of the power inserting edge portion 34 of the first peripheral card 30. A plurality of electrical contacts 421 is formed on a single surface of the data inserting edge portion 42, and a plurality of electrical contacts 441 is formed on opposite surfaces of the power inserting edge portion 44 of the second peripheral card 44.

Referring back to FIG. 1, the connector 20 is inserted into the opening 12 of the riser card 10 and fixed by electric welding or any other suitable method, and the contacts 222, 242, 262, and 282 of the connector 20 are electrically coupled to the circuit traces 15 of the riser card 10. The first data edge connector socket 22 and the first power data edge connector socket 26 face away from the second side of the card body, and The second data edge connector socket 24 and the second power data edge connector socket 28 face away from the first side thereof. The riser card 10 is then perpendicularly installed on the motherboard 50. The first and second peripheral cards 30, 40 are respectively secured on the riser card 10 at opposite sides thereof. The data inserting edge portions 32, 42 of the first and second peripheral cards 30, 40 are respectively inserted into the corresponding data edge connector sockets 22, 24 of the connector 20 of the riser card 10, and the power inserting edge portions 34, 44 are respectively inserted into the power edge connector sockets 26, 28. The contacts 321, 341, 421, and 441 of the first and second peripheral cards 30, 40 are electrically coupled to the contacts 222, 262, 242, and 282 of the first and second data edge connector sockets 22, 24 and the first and second powers edge connector sockets 26, 28 of the connector 20 of the riser card 10, respectively.

Referring also to FIGS. 2-3, the contacts 321 of the data inserting edge portion 32 of the first peripheral card 30 are formed on a surface thereof that will abut the surface of the data edge connector socket 22 corresponding to the contacts 222 therein, thereby the contacts 222 being electrically coupled to the contacts 321 when the data inserting edge portion 32 of the first peripheral card 30 is inserted into the data edge connector socket 22 of the connector 20 of the riser card 10.

Referring also to FIGS. 2 and 4, the contacts 421 of the data inserting edge portion 42 of the second peripheral card 40 are formed on a surface thereof that will abut the surface of the data edge connector socket 24 corresponding to the contacts 242 therein, thereby the contacts 242 of the data edge connector socket 24 being electrically coupled to the contacts 421 when the data inserting edge portion 42 of the peripheral card 40 is inserted into the data edge connector socket 24 of the connector 20 of the riser card 10.

Figure 5:
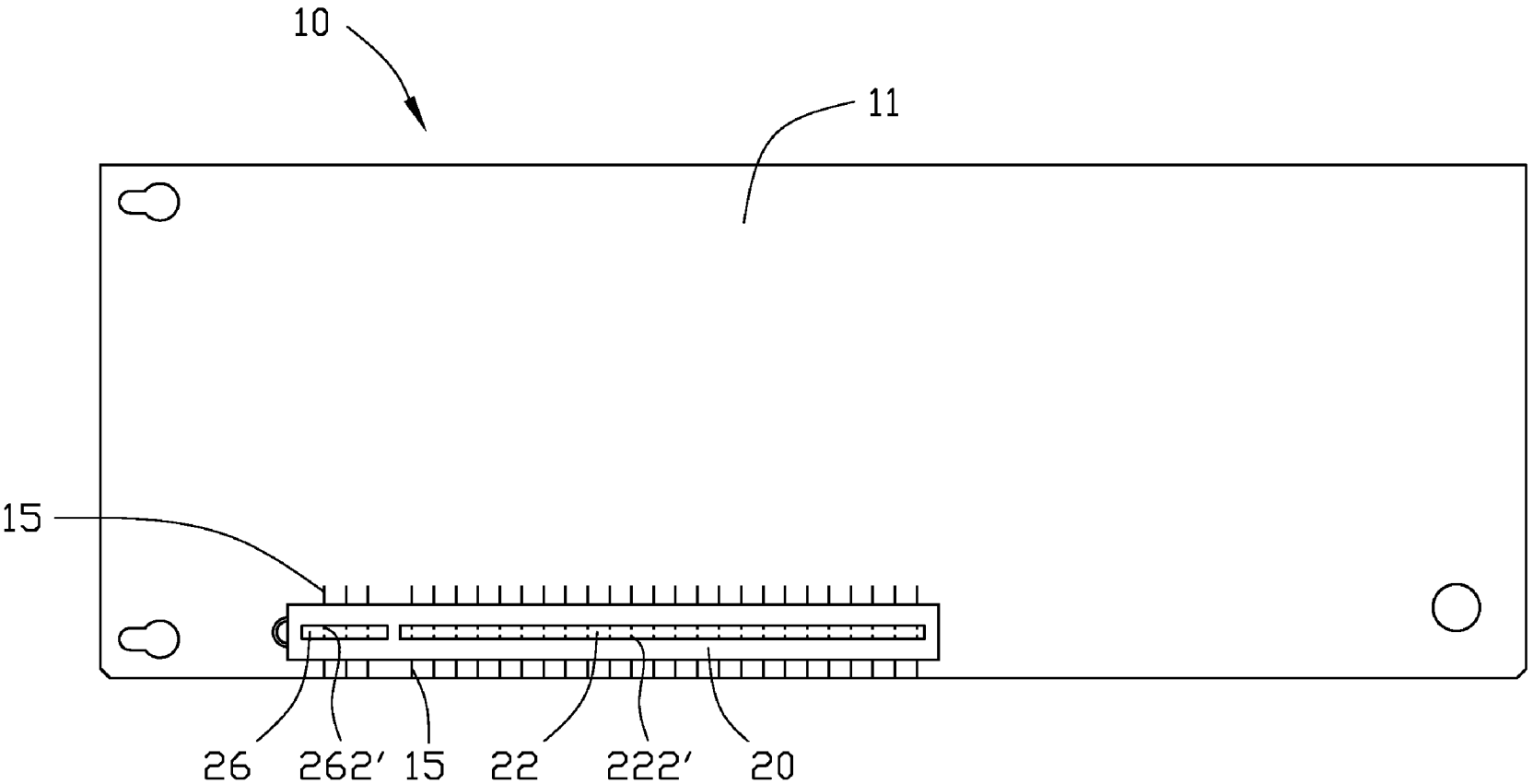
FIG. 5 is a front elevational view of the riser card of an alternative embodiment of the present invention.
Figure 6:
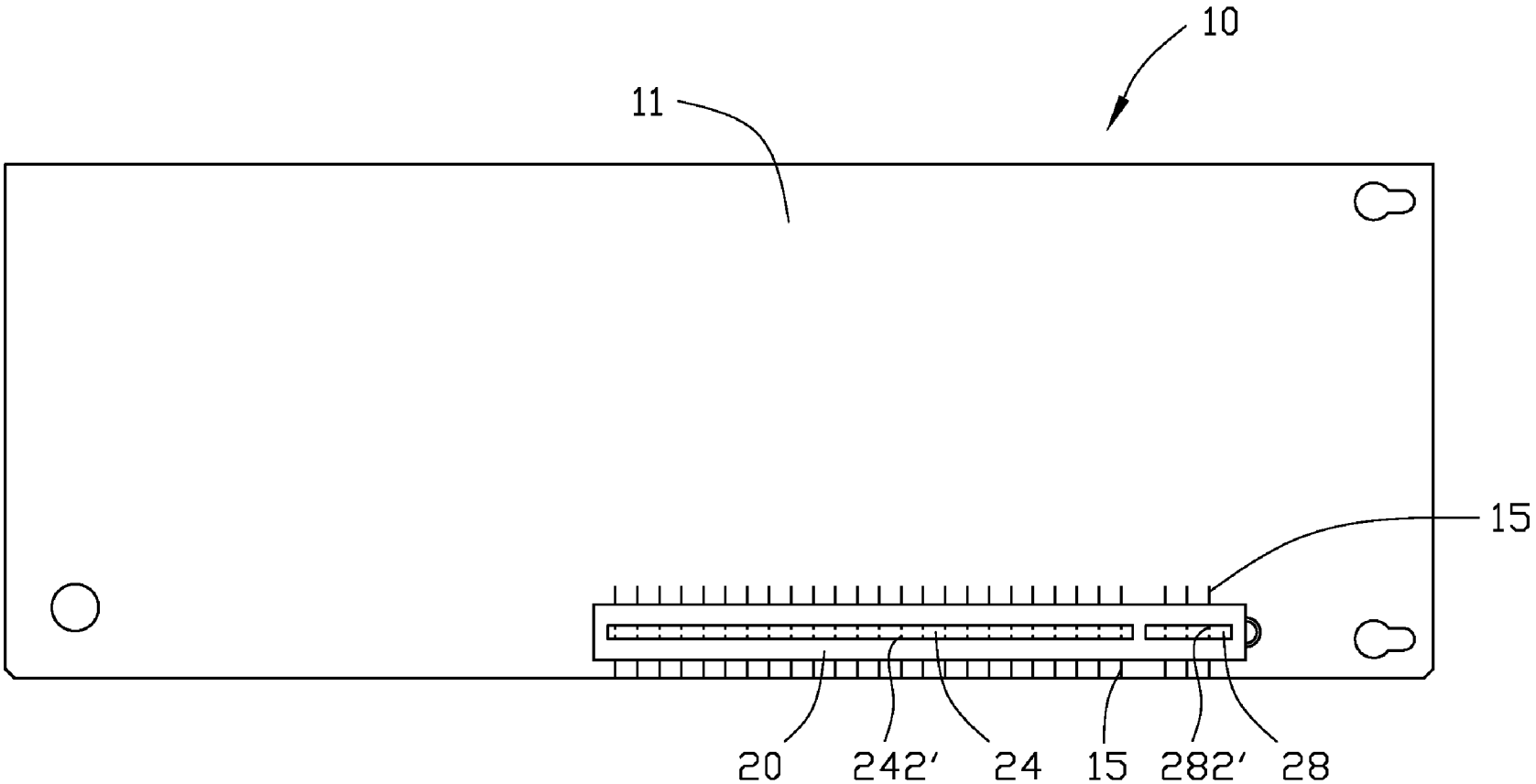
FIG. 6 is a rear elevational view of the riser card of FIG. 5.

An alternative embodiment is shown in FIGS. 5 and 6. In this embodiment, the contacts 222', 242', 262', and 282' of the data edge connector sockets 22, 24 of the connector 20 of the riser card 10 are formed on two facing surfaces thereof, so that the data edge connector sockets 22, 24 and the power edge connector socket 26, 28 can be suitable for any other peripheral cards which have a plurality of contacts formed on two surfaces of a data inserting edge portion and a power inserting edge portion.

It is to be understood, however, that even though numerous characteristics and advantages have been set forth in the foregoing description of preferred embodiments, together with details of the structures and functions of the preferred embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A riser card comprising: a card body defining a through opening therein, and having a first side and an opposite second side; and a connector secured in the through opening of the card body, the connector having a first edge connector socket facing away from the second side of the card body and a second edge connector socket facing away from the first side thereof, the first edge connector socket being located at the first side of the card body for receiving of an edge portion of one peripheral card therein, the second edge connector socket being located at the second side of the card body for receiving of an edge portion of another peripheral card therein;

wherein the card body is a printed circuit board having a plurality of circuit traces formed on edges of the through opening, the connector having a plurality of contacts formed in the first and second edge connector sockets, the contacts in the first and second edge connector sockets electrically coupled to the circuit traces of the card body; and wherein each of the first and second edge connector sockets has two opposite inner surfaces facing each other, the contacts of the first and second edge connector sockets being formed on the opposite inner surfaces thereof.

2. The riser card as described in claim 1, wherein each of the first and second edge connector sockets has an upper inner surface and a lower inner surface, the contacts of the first edge connector socket being formed on the upper inner surfaces thereof, the contacts of the second receiving portion being formed on the lower inner surface.

3. A computer system comprising:

a motherboard;

a riser card electrically coupled to the motherboard;

a connector secured on and electrically coupled to the riser card, the connector having a first data edge connector socket for data transmission, a first power edge connector socket for power transmission, a second data edge connector socket for data transmission, and a second power edge connector socket for power transmission, the first data edge connector socket and the first power edge connector socket located at a first side of the riser card, the second data edge connector socket and the second power edge connector socket located at an opposite second side of the riser card;

a first peripheral card having a data inserting edge portion and a power inserting edge portion respectively inserted in the first data edge connector socket and the first power edge connector socket; and a second peripheral card having a data inserting edge portion and a power inserting edge portion respectively inserted in the second data edge connector socket and the second power edge connector socket of the connector wherein the riser card is a primed circuit board defining a through opening therein, and the connector is secured in the through opening of the riser card; and wherein edges of the through opening of the riser card has a plurality circuit traces formed thereon, the first and second data edge connector sockets and the first and second power edge connector sockets each having a plurality of contacts electrically coupled to the circuit traces of the riser card.

4. The computer system as described in claim 3, wherein the connector is fixed in the opening of the riser card by welding.

5. The computer system as described in claim 3, wherein each of the first and second data edge connector sockets of the connector has face-to-face inner surfaces, the contacts of the first data edge connector sockets being formed on one of the inner surfaces thereof the contacts of the second data edge connector socket being formed on one of the inner surfaces thereof, facing the one of the inner surface of the first data edge connector socket.

6. The computer system as described in claim 3, wherein each of the data edge connector sockets has face-to-face inner surfaces, the contacts of the first and second data edge connector sockets being formed on the inner surfaces.

* * * * *